US007133639B2

(12) United States Patent
Yuyama et al.

(10) Patent No.: US 7,133,639 B2
(45) Date of Patent: Nov. 7, 2006

(54) MEDICINE-BAG PRINTING APPARATUS

(75) Inventors: Shoji Yuyama, Osaka (JP); Yoshihiko Ide, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 13 days.

(21) Appl. No.: 11/003,979

(22) Filed: Dec. 6, 2004

(65) Prior Publication Data

US 2006/0120792 A1 Jun. 8, 2006

(51) Int. Cl.
*G03C 15/00* (2006.01)

(52) U.S. Cl. ..... 399/397; 399/388; 493/186; 101/35

(58) Field of Classification Search ..... 399/397, 399/388

See application file for complete search history.

(56) References Cited

U.S. PATENT DOCUMENTS 6,697,590 B1 * 2/2004 Inoue et al. ..... 399/124
6,892,046 B1 * 5/2005 Fujita et al. ..... 399/381
6,973,286 B1 * 12/2005 Mandel et al. ..... 399/391
2005/0140078 A1 * 6/2005 Fujiwara et al. ..... 271/9.01
2005/0156371 A1 * 7/2005 Takeda et al. ..... 271/113

FOREIGN PATENT DOCUMENTS

JP 60-6553 1/1985
JP 6-315521 11/1994
JP 406315515 A * 11/1994
JP 10-59333 3/1998
JP 410203704 A * 8/1998
JP 2000272764 A * 10/2000

* cited by examiner

*Primary Examiner*—Ren Yan
*Assistant Examiner*—Joshua Zimmerma
(74) *Attorney, Agent, or Firm*—Wenderoth, Lind & Ponack, L.L.P.

(57) ABSTRACT

To provide a medicine-bag printing apparatus provided with a conveying mechanism that can smoothly convey medicine bags and align them. A medicine bag (2 ) is printed by any one of a plurality of printers (11, 12 ) to be collected in a collecting portion (5 ) via a conveying route (6, 13, 14). The printing apparatus is provided with medicine-bag direction converting device (6, 14 ) which convert the direction of medicine bags printed by the respective printers so the printing surface and the printing direction become same.

9 Claims, 8 Drawing Sheets

MEDICINE-BAG PRINTING APPARATUS

BACKGROUND OF THE INVENTION

The present invention relates to a medicine-bag printing apparatus, in particular to a medicine-bag printing apparatus characterized by a conveying structure of medicine bags after printing information on them.

As a mechanism for conveying paper, there is one that is enabled to convey paper while changing a position of the paper (e.g., see Patent Document 1).

Patent Document 1: JP-60-6553(A)

However, when the above construction is applied to a medicine-bag printing apparatus equipped with a plurality of printers, its construction becomes complicated and such a printing apparatus inevitably becomes expensive.

An object of the present invention is to provide a medicine-bag printing apparatus including a conveying mechanism that can smoothly convey medicine bags and align them in spite of its simple and inexpensive construction.

SUMMARY OF THE INVENTION

As a means of solving the above problem, the present invention provides a medicine-bag printing apparatus in which a medicine bag is printed by any one of a plurality of printers and collected in a collecting portion via a conveying route, wherein comprising a medicine-bag direction converting means which converts the direction of medicine bags printed by the respective printers so that printing surface and the printing direction become same.

With this construction, it always becomes possible to align medicine bags in the same direction and collect them regardless of the type of printer used.

The medicine-bag direction converting means comprises a first conveying route in which a medicine bag fed downward from the printer is conveyed downward; and a second conveying route in which a medicine bag is conveyed upward and then this conveying direction is converted downward.

With this construction, even if warping and the like occur with medicine bags when they pass through the printer, it becomes possible to collect them in a collecting portion in a stable state while taking the direction of the warping into account.

If a part of the first conveying route comprises a first conveying path directed obliquely downward, a part of the second conveying route comprises a second conveying path directed obliquely upward, and the rest of both of the conveying routes comprises a common conveying path including a plurality of conveying rollers disposed in parallel in an up-and-down direction and a conveying belt provided along the conveying rollers, which can be driven both normally and reversely, it becomes possible to take an inexpensive construction that suppresses the occupation space and the number of components, which is preferred.

If auxiliary rollers for biasing the conveying belt toward the conveying rollers are provided, it becomes possible to convey the medicine bags, in particular convey them upward smoothly, which is preferred.

If a guiding piece for guiding medicine bags is provided at a bottom edge portion of the common conveying path, it becomes possible to surely align the medicine bags that fall onto the collecting portion from the common conveying path, which is preferred.

If the guiding piece is rotatable only when a medicine bag passes through in a manner so as to guide the medicine bag, it becomes possible to smoothly take out the medicine bag from the collecting portion without being obstructed by the guiding piece, which is preferred.

According to the present invention, since the medicine-bag direction converting means is provided, medicine bags can always be aligned in the desired direction to be taken out, which is preferred.

BEST MODE FOR CARRYING OUT THE INVENTION

An embodiment according to the present invention will hereinafter be described with reference to the accompanying drawings.

Figure 1:
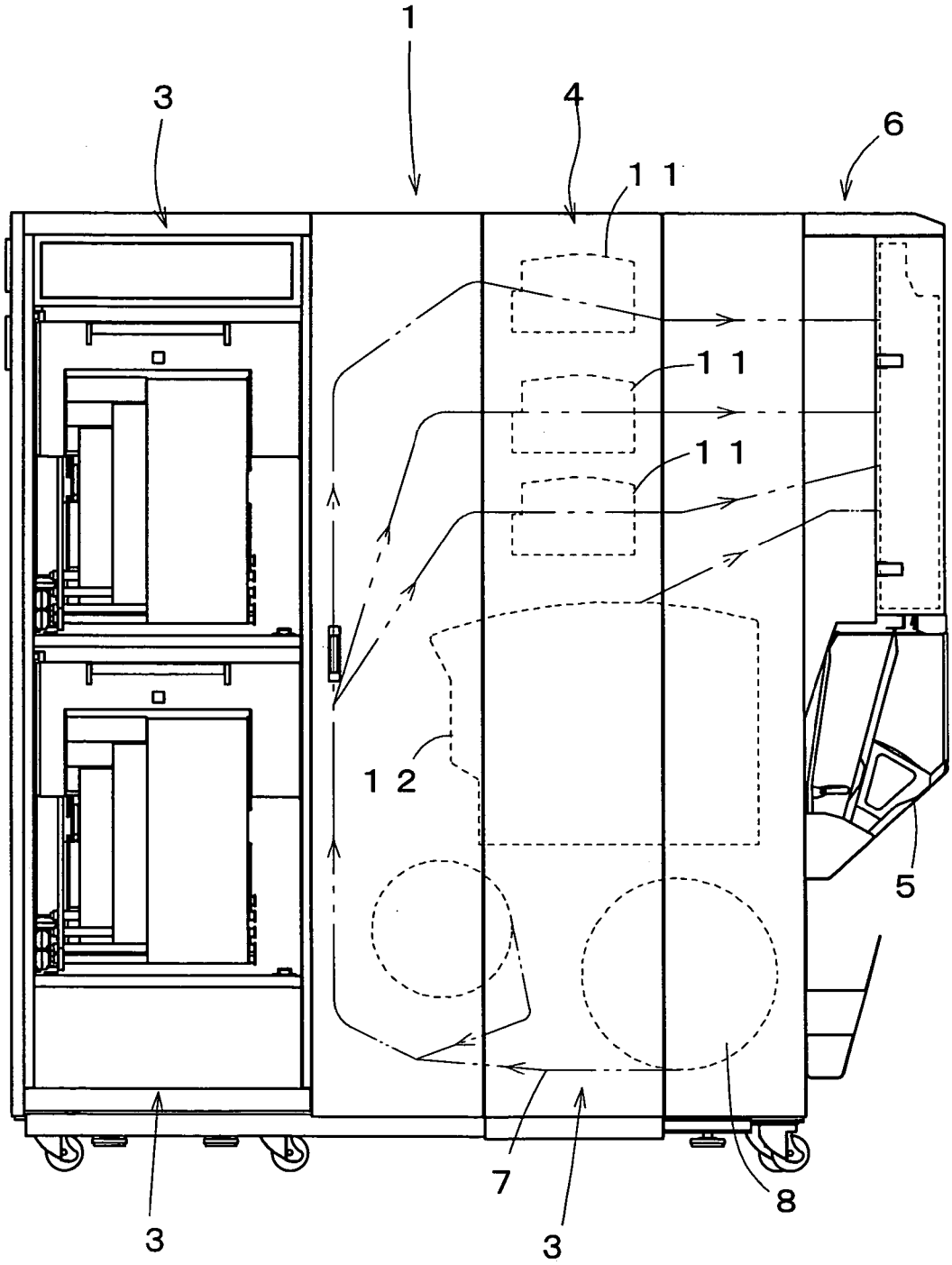
FIG. 1 is a front elevation of a medicine-bag printing apparatus according to the present embodiment.

FIG. 1 shows a medicine-bag printing apparatus according to the present invention. This medicine-bag printing apparatus includes an apparatus body 1 having medicine-bag forming portions 3 that form medicine bags 2, a medicine-bag printing portion 4 that prints predetermined information on the medicine bags 2, and a medicine-bag conveying portion 6 that conveys the medicine-bags 2 to a collecting portion 5 after printing the predetermined information on the medicine bags 2.

In FIG. 1, medicine-bag forming portions 3 are provided in two places which are the top and bottom on the left side, and one place which is the central lower part. The respective medicine-bag forming portions 3 are adapted to produce medicine bags 2 of different sizes and types and feed them. Since they have the same structure, giving as an example the medicine-bag forming portion 3 disposed in the central lower part, its structure will be described.

Figure 2:
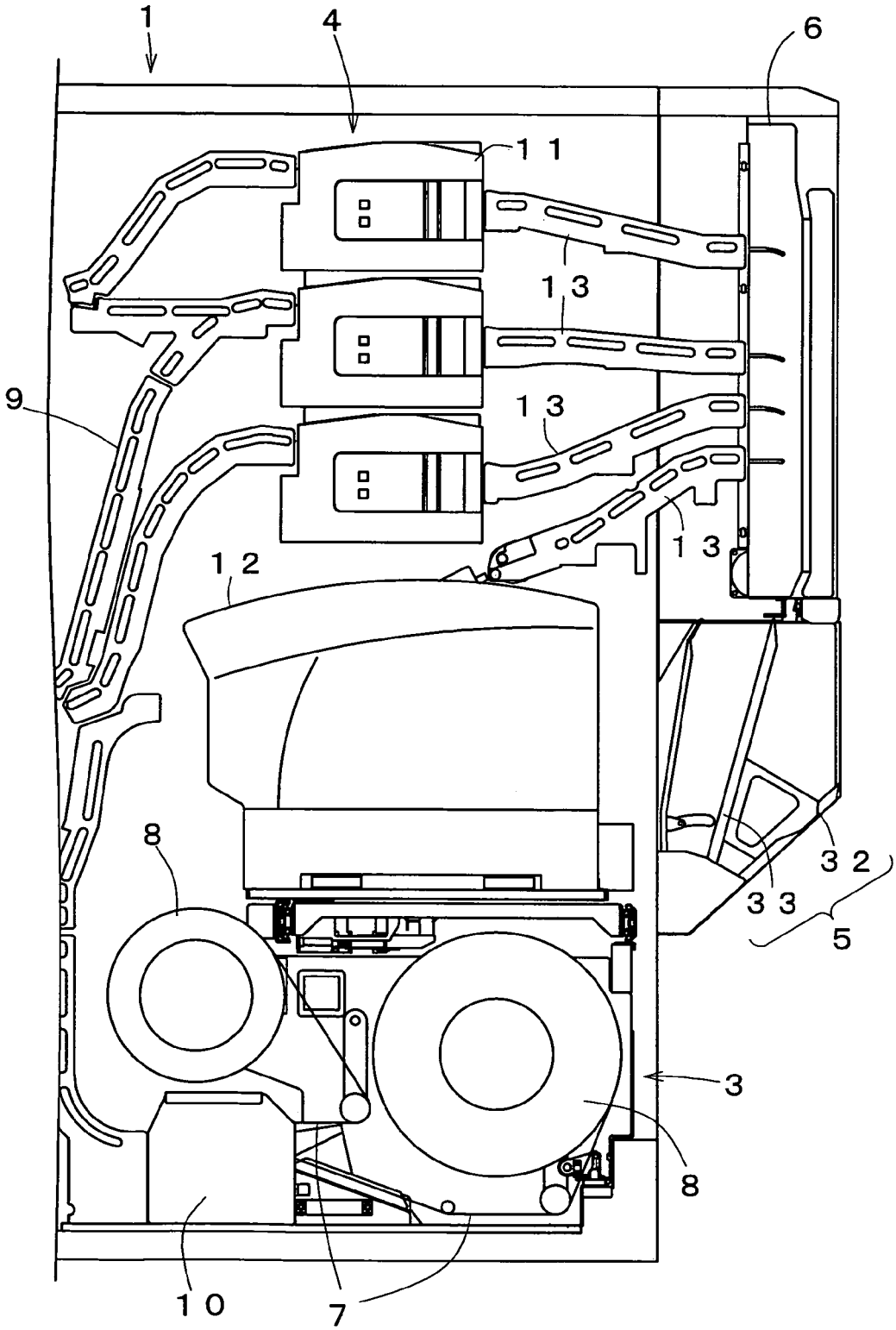
FIG. 2 is a partially enlarged sectional view of FIG. 1.

That is, in the medicine-bag forming portion 3, a plurality of medicine-bag rolls 8 of different sizes, each of which rolls is obtained by winding a medicine-bag sheet 7 that has been previously folded in two in a longitudinal direction, are freely detachably attached as shown in FIG. 2. The medicine-bag sheet 7 fed from these medicine-bag rolls 8 is sealed at predetermined intervals by a seal cutting device 10 and cut simultaneously to form medicine bags 2. Each medicine-bag forming portion 3 can be pulled out to the front from the apparatus body 1 for exchanging medicine-bag rolls 8.

In the medicine-bag printing portion 4, a plurality of printers is disposed in an up-and-down direction as shown in FIG. 2. Ones that are positioned at three places in the upper part are ink jet printers 11, while one positioned in the lowermost part is a laser printer 12.

Each of the printers 11, 12 receives prescription information from an unshown control portion and prints medicine information, such as a patient name, medicine name, dosage time, effectiveness and side effect, on a medicine bag 2 fed from the corresponding medicine-bag forming portion 3 in accordance with the prescription information. In addition to such prescription information, images of medicines can be printed.

Medicine-bag discharge paths 13 are formed, extending from the respective printers 11, 12 to the medicine-bag conveying portion 6.

The medicine-bag conveying portion 6 includes medicine-bag conveying paths 14*a*, 14*b*, 14*c*, 14*d* that communicate with the respective medicine-bag discharge paths 13, a plurality of conveying rollers 15 and a conveyer 16.

Figure 3:
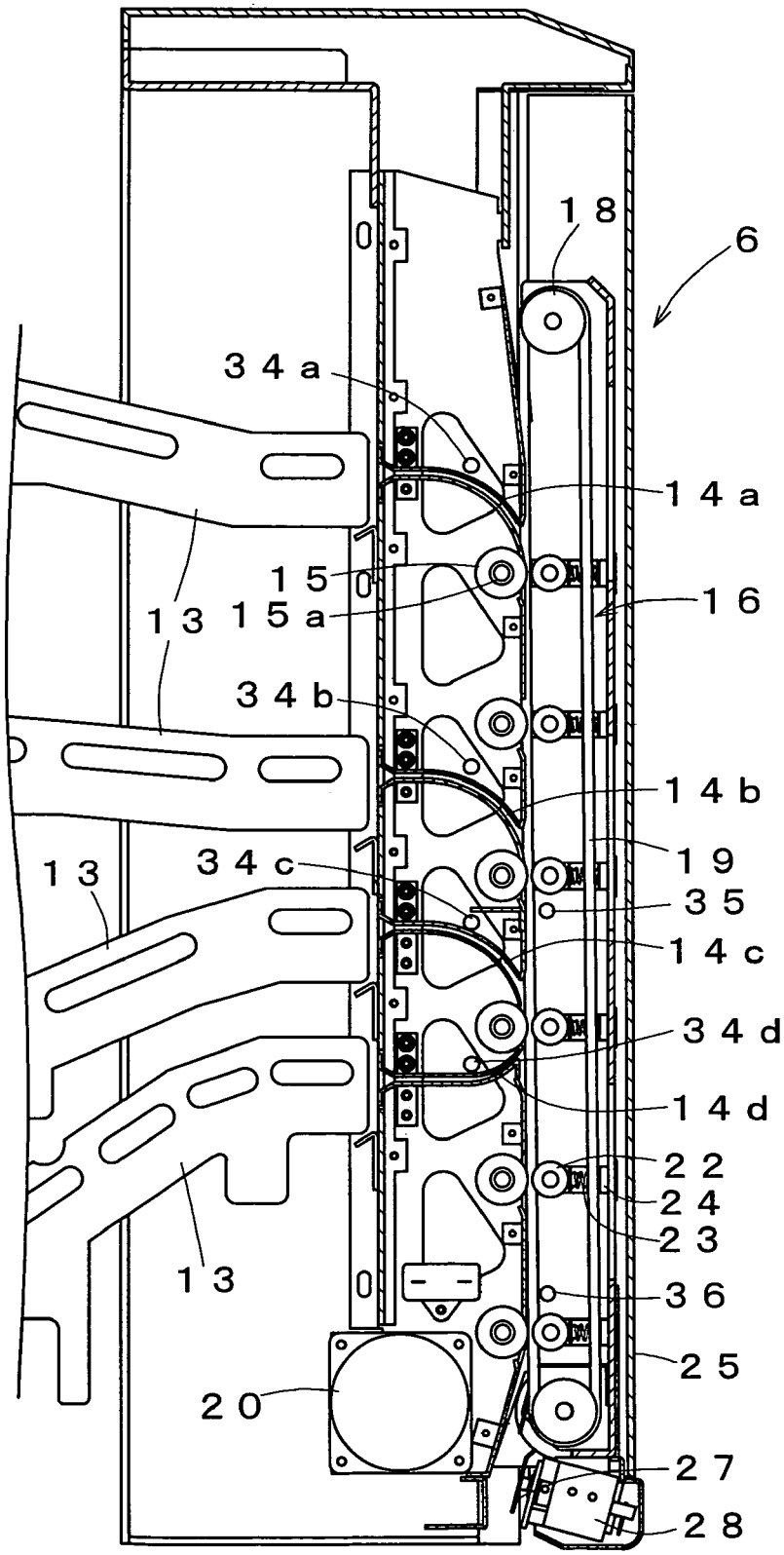
FIG. 3 is a partially enlarged view of FIG. 2.

As shown in FIG. 3, the medicine-bag conveying paths 14*a*, 14*b*, 14*c* are curved in a manner so as to be gradually directed downward, which enables a medicine bag 2 that passes through to be directed vertically downward smoothly without folding the medicine bag 2. The conveying rollers 15 and the conveyer 16 constitute a first medicine-bag conveying route according to the present invention. The medicine-bag conveying path 14*d* is curved in a manner so as to be gradually directed upward, which enables a medicine bag 2 that passes through to be directed vertically upward smoothly without folding the medicine bag 2. The medicine-bag conveying path 14*d*, the conveying rollers 15 and the conveyer 16 constitute a second conveying route according to the present invention. The conveying rollers 15 and the conveyer 16 constitute a common conveying path according to the present invention.

Figure 4:
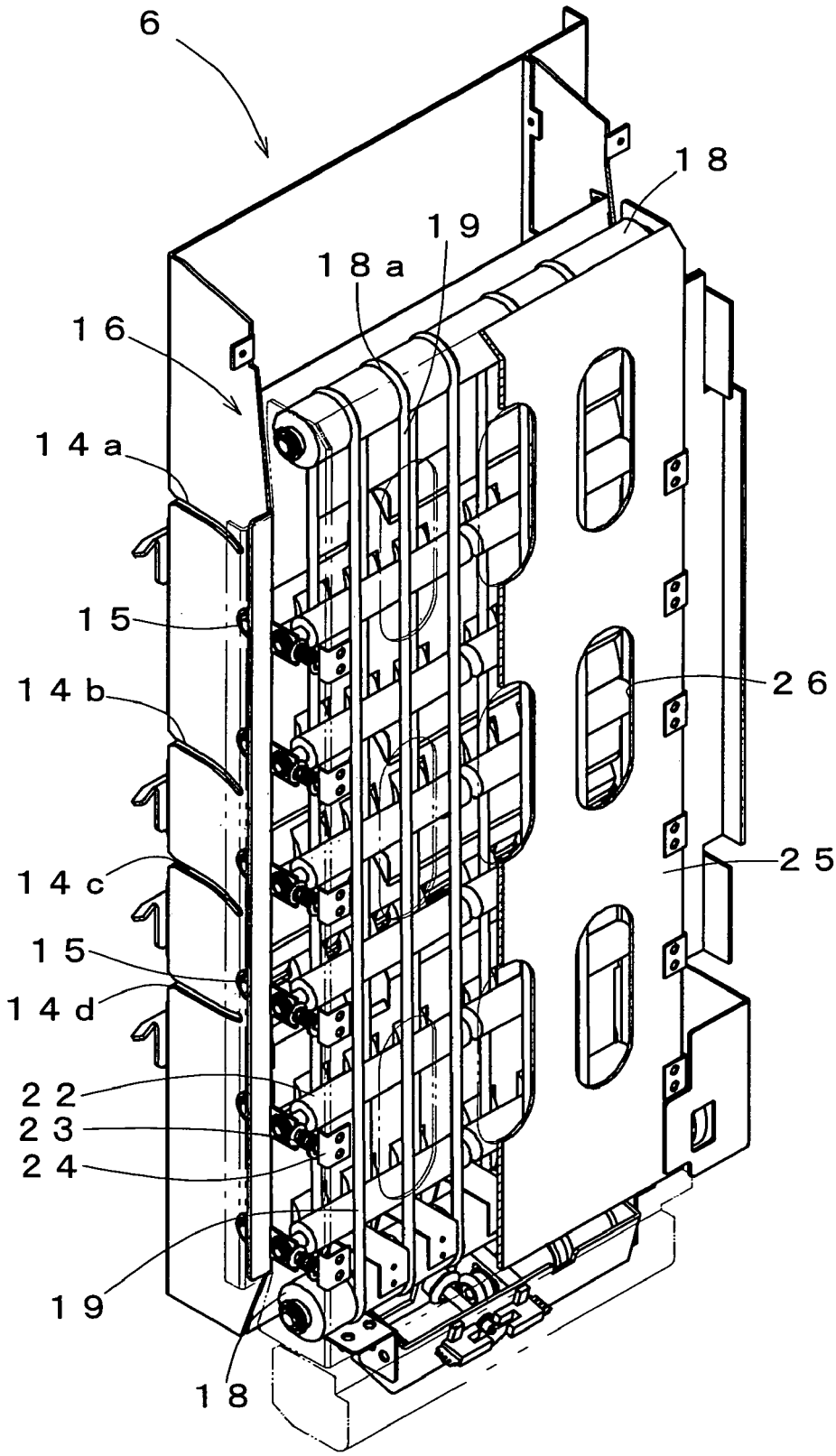
FIG. 4 is a partially broken perspective view showing a medicine-bag conveying portion of FIG. 1.
Figure 5:
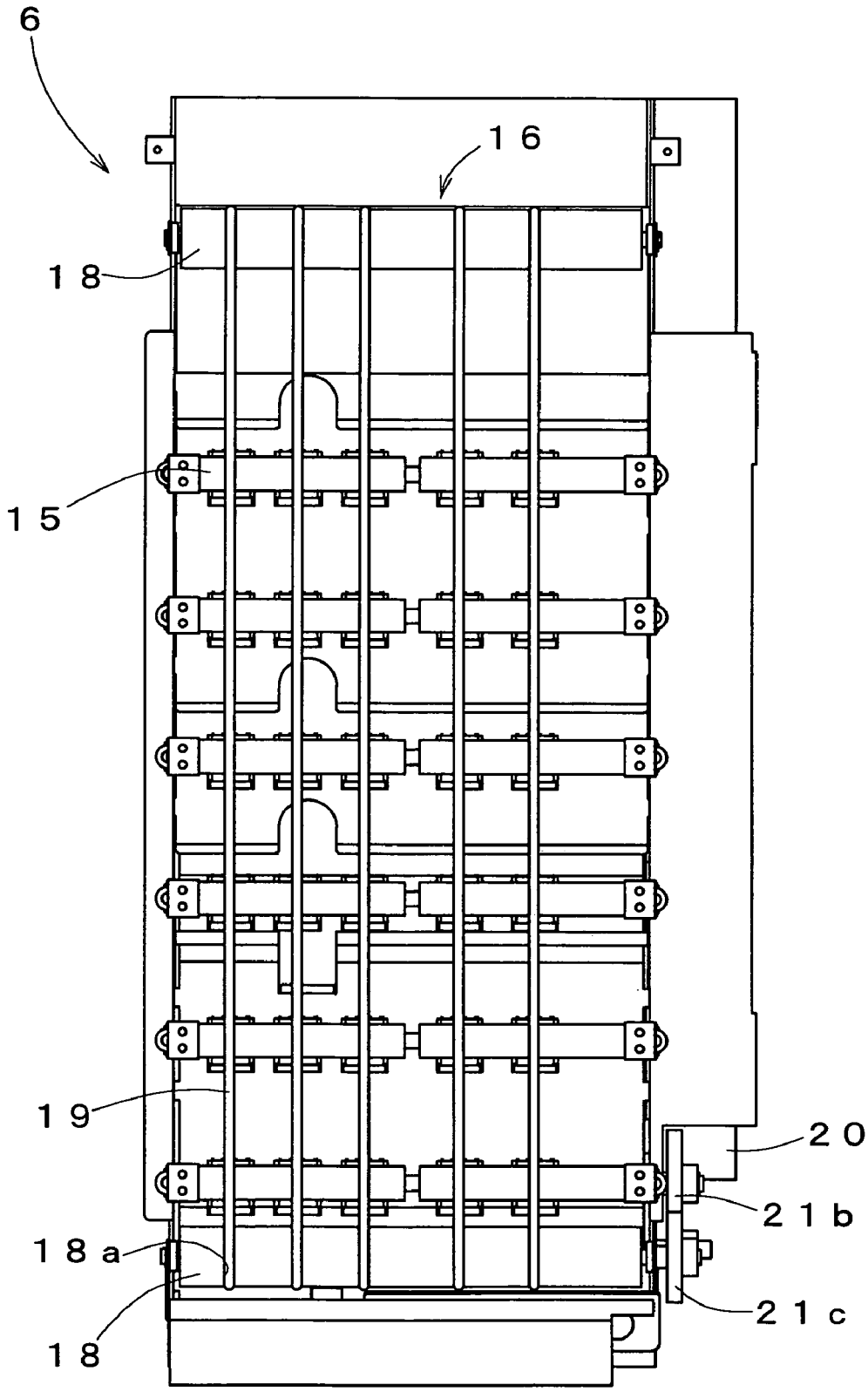
FIG. 5 is a side view showing the medicine-bag conveying portion of FIG. 1.

As shown in FIG. 4 and FIG. 5, a plurality of rows of conveying rollers 15, which are provided at predetermined intervals in an up-and-down direction, are fixed in a widthwise direction to a plurality of support shafts 15*a*, which are provided at predetermined intervals in an up-and-down direction, so that the conveying rollers 15 are freely rotatable.

Figure 6:
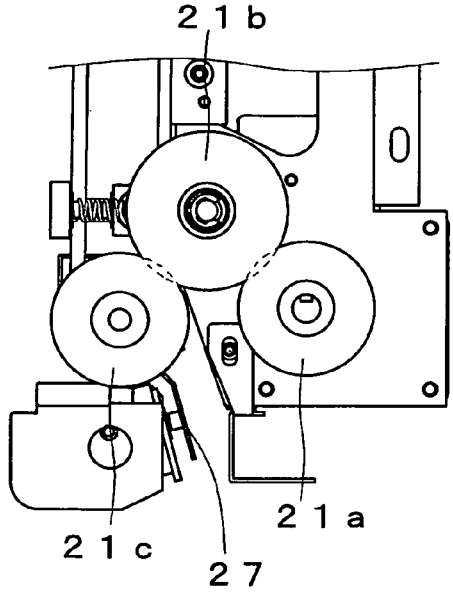
FIG. 6 is a partially enlarged view showing a driving mechanism of a guiding piece shown in FIG. 4.

The conveyer 16 is formed by hanging a plurality of round belts 19 on driving rollers 18 disposed above and below. Annular grooves 18*a* are formed in the circumference of each driving roller 18, so that displacement of the round belts 19 is prevented. Thereby, each round belt 19 is disposed in a manner so as to be opposed to the respective conveying rollers 15 that are disposed in the up-and-down direction. Further, the driving roller 18 positioned on the lower side is rotated by driving of a motor 20 via gears 21*a*, 21*b*, 21*c* as shown in FIG. 3 and FIG. 6.

The round belt 19 is biased to each conveying roller 15 by an auxiliary roller 22 as shown in FIG. 3 through FIG. 5. The auxiliary rollers 22, which are disposed inside the round belts 19, are parallel to the driving rollers 18. Both end portions of each of the auxiliary rollers 22 are biased to a side of the conveying roller 15 by a spring 23. The springs 23 are fixed to a roller cover 25 through retainers 24.

Figure 8:
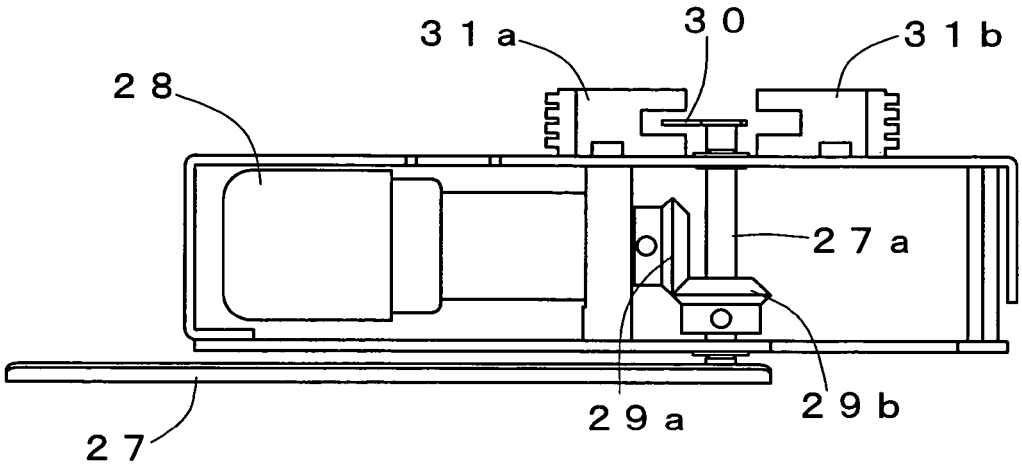
FIG. 8 is a plan view showing the driving mechanism of a guiding piece shown in FIG. 4.
Figure 9:
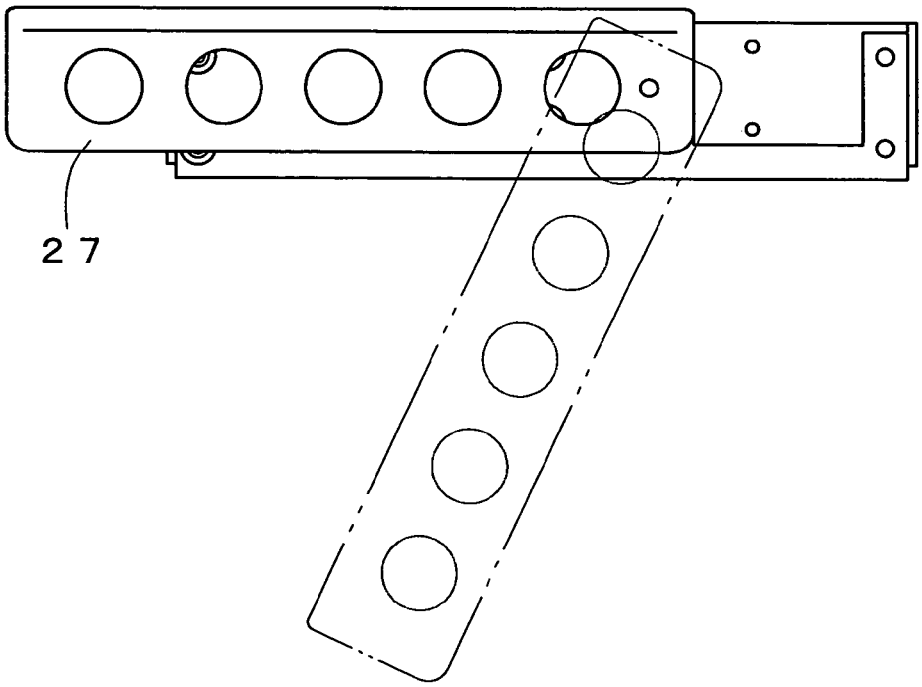
FIG. 9 is a front elevation of the guiding piece shown in FIG. 8.
Figure 10:
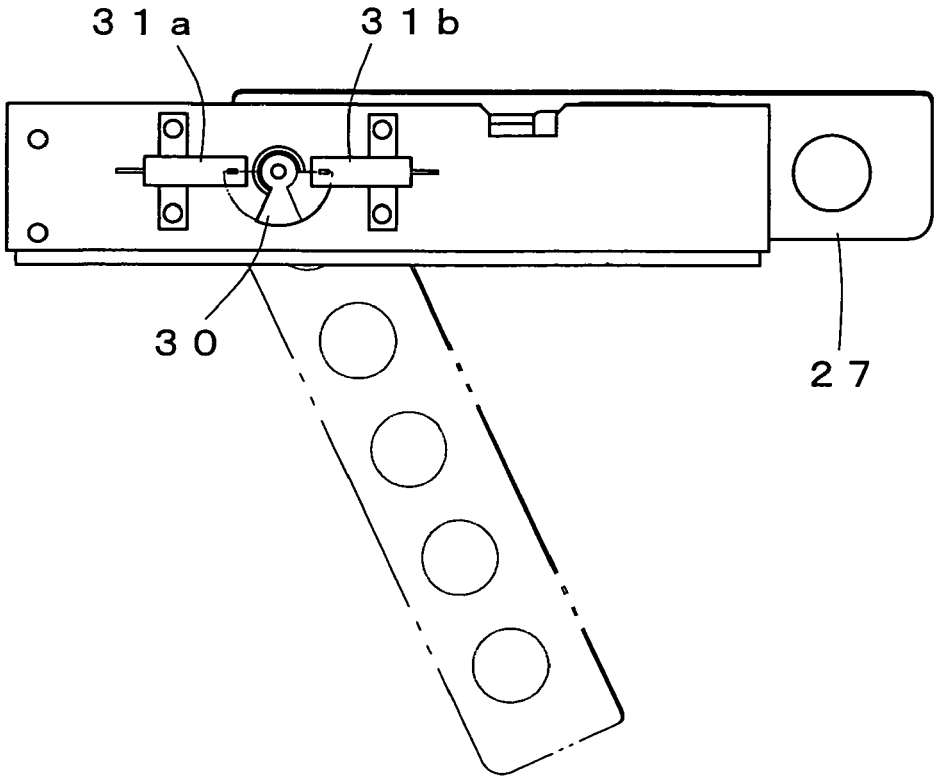
FIG. 10 is a rear elevation of the guiding piece shown in FIG. 8.

As shown in FIG. 4, the roller cover 25, which covers the conveying rollers 15, the auxiliary rollers 22 and the round belts 19, is formed with a plurality of elongated holes 26 so that a conveying condition of medicine bags 2 by these respective members can be checked. As shown in FIG. 3, a guiding piece 27 is provided so as to be rotatable about a support shaft 27*a* as the center at a bottom edge portion of the roller cover 25. The guiding piece 27 is rotated by driving of a motor 28 via gears 29 as shown in FIG. 8. A detecting piece 30 is detected by detecting sensors 31 provided on the support shaft, whereby the rotational range of the guiding piece 27 is defined from a guiding position where the guiding piece 27 protrudes in an obliquely downward direction from the front to the side of the roller cover 25 (in FIG. 9, shown in a chain double-dashed line) to a waiting position where the guiding piece 27 is housed in the roller cover 25 (in FIG. 9, shown in a solid line).

As shown in FIG. 2, the collecting portion 5 is so constructed that the inside of a box-shaped medicine-bag collecting tray 32, which is open obliquely upward, is partitioned by a switching board 33. In the collecting portion 5, changing a rotational position of the switching board 33 makes it possible to sort medicine bags 2 conveyed to the collecting portion 5 into patient by patient.

Medicine-bag detecting sensors 34*a*–34*d*, 35, 36 for detecting medicine bags 2 passing through are provided midway in the respective medicine-bag conveying paths 14*a*–14*d*, as well as in two places of the upper and lower parts of the common conveying path.

Next, operation of the medicine-bag printing apparatus will be described.

When prescription information is inputted by an operator or from an unshown host computer, the size of a medicine bag 2 is selected based on the type and amount of medicine to be prescribed, and the medicine-bag forming portion 3 feeding medicine bags 2 of the size is designated.

In the designated medicine-bag forming portion 3, the medicine-bag sheet 7 is drawn out of the medicine-bag roll 8 and sealed at predetermined intervals by the seal cutting device 10 and cut simultaneously, thus forming a medicine bag 2. The medicine bag 2 is sorted into any one of the printers that are ready and waiting through any one of the conveying paths to be conveyed. In the printer 11, 12, medicine information such as a patient name, medicine name, dosage time, effectiveness and side effect is printed in accordance with the prescription information.

In the ink jet printers 11, information is printed on a top surface of a medicine bag 2. The printed medicine bag 2, which is directed downward from a medicine bag discharge path 13, passes through any one of the medicine-bag conveying paths 14*a*–14*c* and is then conveyed to the medicine-bag conveying portion 6. At this time, the medicine bag 2 is detected by any one of the medicine-bag detecting sensors 34*a*–34*c*.

Figure 7A:
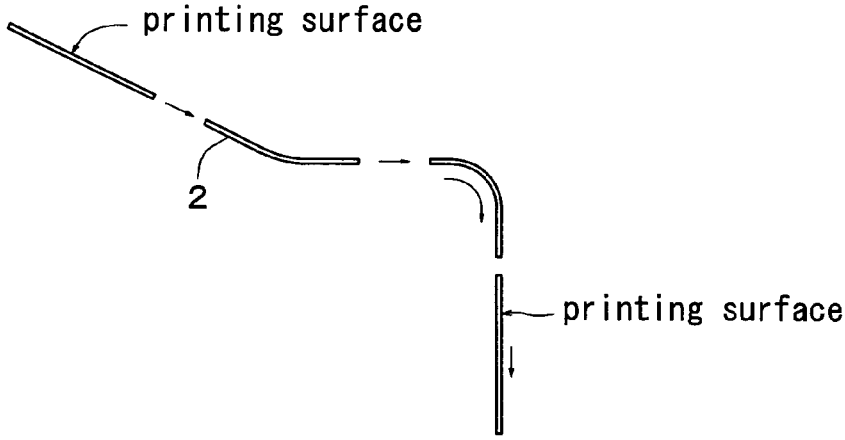
FIG. 7 is a schematic explanatory view showing conveying routes of medicine bags.

In the medicine-bag conveying portion 6, the auxiliary rollers 22, which have been biased by the springs 23, are pressing the round belts 19 against the conveying rollers 15. Then, based on detected signals of the medicine bag detecting sensors 34*a*–34*c*, the motor 20 is driven and the driving rollers 18 are rotated. Thereby, the round belts 19 are moved downward at positions opposing the conveying rollers 15. Therefore, as shown in FIG. 7A, the medicine bag 2 conveyed to the medicine-bag conveying portion 6 is held between the round belts 19 and the conveying rollers 15 and moved to the collecting portion 5 led by the round belts 19. Thereby, the medicine bag 2 falls in a manner such that its printing surface is directed toward an inclined surface of the medicine-bag collecting tray 32. The medicine bag 2, whose printing surface is thus formed, is-curved in a manner such that the printing surface side protrudes. Therefore, the medicine bag 2 is collected in a manner such that its printing surface is along with the inclined surface in the medicine-bag collecting tray 32, with the result that no paper jam and the like occur.

Figure 7B:
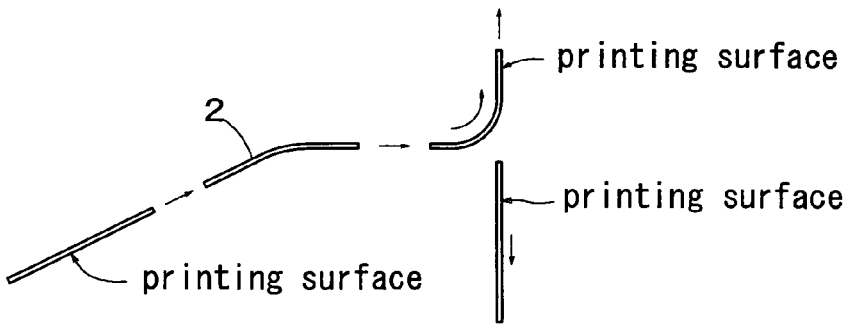

In the case where the laser printer 12 is designated, the medicine-bag sheet 7 fed from the medicine-bag roll 8 is sealed at predetermined intervals by the seal cutting device 10 and cut simultaneously to form a medicine bag 2. Medicine information such as a patient name, medicine name, dosage time, effectiveness and side effect is printed on a lower surface of the medicine bag 2 in accordance with the prescription information. As shown in FIG. 7B, the printed medicine bag 2 passes the medicine-bag conveying path 14*d* and is thereby directed upward to be conveyed to the medicine-bag conveying portion 6. At this time, the medicine bag 2 is detected by the medicine-bag detecting sensor 34*d*. Then, based on detected signals, conveyance of the medicine bag 2 to the medicine-bag conveying portion 6 is stopped.

In the medicine-bag conveying portion 6, based on the detected signals in the medicine-bag detecting sensor 34*d*, the motor 20 is reversed, so that the driving rollers 18 are rotated in the opposite direction to that in which the medicine bag 2 is printed by the ink jet printer 11. Thereby, the medicine bag 2 conveyed to the medicine-bag conveying portion 6 is directed upward temporarily. Thereafter, when the medicine bag 2 is completely conveyed to the medicine-bag conveying portion 6 from the medicine-bag conveying path 14*d*, it is detected by the medicine-bag detecting sensor 35. Then, the motor 20 is stopped and normally rotated again so that the driving rollers 18 are normally rotated, whereby the conveying direction of the medicine bag 2 is switched from up to down. This enables the printing surface of the medicine bag 2 to be directed to the left side in FIG. 7B, namely in the same direction as the medicine bag 2 printed by the ink jet printer 11. Incidentally, the motor 20 is stopped by the medicine-bag detecting sensor 36 detecting the medicine bag 2.

Figure 11:
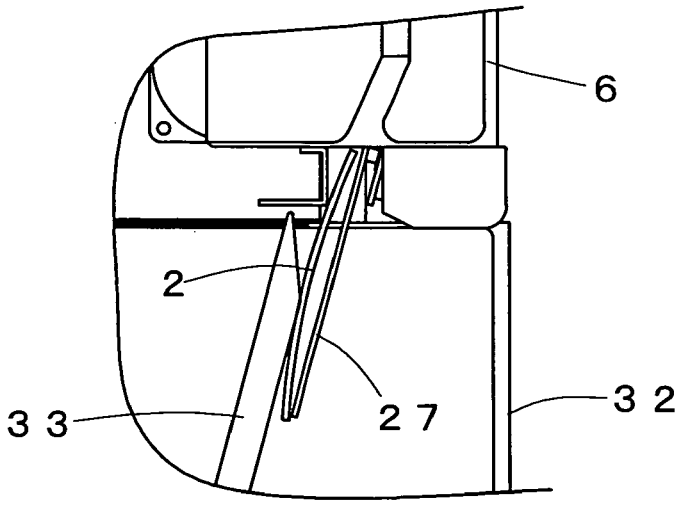
FIG. 11 is a partially enlarged view showing an operating state of the guiding piece shown in FIG. 8.

The medicine bag 2, whose direction has thus been converted, is guided by the guiding piece 27 when conveyed from the medicine-bag conveying portion 6 to the medicine-bag collecting tray 32. That is, as shown in FIG. 11, when the medicine bag 2 free-falls onto the medicine-bag collecting tray 32 from the medicine-bag conveying portion 6, the guiding piece 27 is rotated to protrude at the guiding position on the lower side as shown in FIG. 11. Although the medicine bag 2 is curved in a manner such that its printing surface is recessed, its deformation amount is kept small because it is guided by the guiding piece 27 and is thus collected in the medicine-bag collecting tray 32 smoothly. The guiding piece 27 is to protrude toward the guiding position on the lower side for only a predetermined period of time during which the medicine bag 2 is passing through. After the time elapses, the guiding piece 27 is rotated to the original waiting position.

What is claimed is:

1. A medicine-bag printing apparatus comprising:

a plurality of printers for printing on medicine bags;

a collecting portion for collecting the printed medicine bags via a conveying route; and a medicine-bag direction converting means for converting directions of the medicine bags printed by the plurality of printers so that the medicine bags can be collected with the same printing surface side and the same printing direction, wherein the medicine-bag direction converting means comprises a first conveying route in which a medicine bag fed from one of the printers is conveyed downward toward the collecting portion, and a second conveying route in which a medicine bag conveyed from another one of the printers is conveyed in an upward conveying direction, and then the upward conveying direction is converted to a downward conveying direction, wherein a part of the first and second conveying routes comprises a common conveying path which is disposed in an up-and-down direction and can be driven in both a normal direction and a reverse direction.

2. A medicine-bag printing apparatus according to claim 1, wherein:

a part of the first conveying route comprises first conveying paths directed obliquely downward;

a part of the second conveying route comprises a second conveying path directed obliquely upward; and the common conveying routes comprise a plurality of conveying rollers disposed in parallel in an up-and down direction and conveying belts provided along the conveying rollers, which can be driven both normally and reversely.

3. A medicine-bag printing apparatus according to claim 2, further comprising auxiliary rollers for urging the conveying belts toward the conveying rollers.

4. A medicine-bag printing apparatus according to claim 2, further comprising a guiding piece for guiding a medicine bag, the guiding piece being provided at a bottom edge portion of the common conveying path.

5. A medicine-bag printing apparatus according to claim 4, wherein the guiding piece is rotatable only when a medicine bag passes through in a manner so as to guide the medicine bag.

6. A medicine-bag printing apparatus according to claim 3, further comprising a guiding piece for guiding a medicine bag, the guiding piece being provided at a bottom edge portion of the common conveying path.

7. A medicine-bag printing apparatus comprising:

a plurality of printers for printing on medicine bags, said plurality of printers including at least a first printer and a second printer;

a collecting section for collecting the printed medicine bags;

a first structure defining a first discharge path extending from the first printer;

a second structure defining a second discharge path extending from the second printer;

a third structure defining a first medicine-bag conveying path communicating with the first discharge path;

a fourth structure defining a second medicine-bag conveying path communicating with the second discharge path; and a medicine-bag conveying device for receiving medicine-bags from the first and second medicine-bag conveying paths and conveying the medicine-bags to the collecting section, the medicine-bag conveying device being operable to convey the medicine bags in an up-and-down direction, and capable of being driven in a normal direction toward the collecting section and in a reverse direction away from the collecting section;

wherein the first medicine-bag conveying path is directed downwardly to permit a printed medicine bag to be moved to the collecting section via the medicine-bag conveying device in a desired orientation, wherein the second medicine-bag conveying path is directed upwardly to permit a printed medicine bag to be delivered to the medicine-bag conveying device, and when the medicine-bag is delivered via the second medicine-conveying path, the medicine-bag conveying device is driven in the reverse direction to convert the orientation of the medicine-bag to the desired orientation so that the medicine bags can be collected with the same printing surface side and the same printing direction.

8. The medicine-bag printing apparatus as claimed in claim 7, further comprising first and second medicine-bag sensors disposed along the first and second conveying paths, respectively.

9. The medicine-bag printing apparatus as claimed in claim 7, wherein the medicine-bag conveying device comprises a plurality of conveying rollers disposed in parallel in the up-and down direction and conveying belts provided along the conveying rollers, which can be driven in the normal direction and in the reverse direction.

* * * * *

UNITED STATES PATENT AND TRADEMARK OFFICE

CERTIFICATE OF CORRECTION

PATENT NO. : 7,133,639 B2
APPLICATION NO. : 11/003979
DATED : November 7, 2006
INVENTOR(S) : Shoji Yuyama et al.

It is certified that error appears in the above-identified patent and that said Letters Patent is hereby corrected as shown below:

ON THE FRONT PAGE

In the abstract, line 7, "which convert the direction" should read --which converts the direction--.

In the abstract, line 8, "so the" should read --so that the--.

In the abstract, line 9, "become same." should read --become the same.--

IN THE SPECIFICATION

In column 1, line 5, "structure of medicine" should read --structure for conveying medicine--.

In column 1, line 9, "see Patent Document 1" should read --see JP-60-6553--.

In column 1, line 10, delete "Patent Document 1: JP-60-6553(A)".

In column 1, line 24, "route, wherein comprising" should read --route.--.

In column 1, line 25, "a medicine-bag" should read --The printing apparatus includes a medicine-bag--.

In column 1, line 27, "so that printing" should read --so that the printing--.

In column 1, line 28, "become same" should read --become the same--.

In column 1, line 51, "to take" should read --to provide--.

In column 1, line 60, "to surely align" should read --to reliably align--.

UNITED STATES PATENT AND TRADEMARK OFFICE

CERTIFICATE OF CORRECTION

PATENT NO. : 7,133,639 B2
APPLICATION NO. : 11/003979
DATED : November 7, 2006
INVENTOR(S) : Shoji Yuyama et al.

It is certified that error appears in the above-identified patent and that said Letters Patent is hereby corrected as shown below:

In column 2, lines 31-32 "BEST MODE FOR CARRYING OUT THE INVENTION" should read --DETAILED DESCRIPTION OF THE INVENTION--.

In column 2, lines 53-55, "sizes, each of rolls is obtained by winding a medicine-bag sheet 7 that has been previously folded in two in a longitudinal direction, are" should read --sizes are--.

In column 2, line 56, after "Fig. 2.", insert --Each of the rolls 8 is obtained by winding a medicine-bag sheet 7 that has been previously folded in two in a longitudinal direction.--.

In column 3, line 6, "Ones that are" should read --Printers that are--.

In column 3, line 7, "while one" should read --while the one--.

In column 3, line 10, "from an unshown control portion" should read --from control portion (not shown)--.

In column 4, line 28, "is inputted by" should read --is input by--.

In column 4, line 32, "the size" should read --the selected size--.

In column 5, line 2, "paper jam" should read --paper jams--.

In column 5, line 9, "side effect" should read --side effects--.

UNITED STATES PATENT AND TRADEMARK OFFICE

CERTIFICATE OF CORRECTION

PATENT NO. : 7,133,639 B2
APPLICATION NO. : 11/003979
DATED : November 7, 2006
INVENTOR(S) : Shoji Yuyama et al.

It is certified that error appears in the above-identified patent and that said Letters Patent is hereby corrected as shown below:

In column 5, line 33, “left side” should read --right side--.

Signed and Sealed this

Twentieth Day of March, 2007

JON W. DUDAS
*Director of the United States Patent and Trademark Office*